US006940478B2

(12) United States Patent
Yoshihara et al.

(10) Patent No.: US 6,940,478 B2
(45) Date of Patent: Sep. 6, 2005

(54) LIQUID CRYSTAL DISPLAY DEVICE

(75) Inventors: Toshiaki Yoshihara, Kawasaki (JP); Keiichi Betsui, Kawasaki (JP); Tetsuya Makino, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 276 days.

(21) Appl. No.: 10/047,732

(22) Filed: Jan. 15, 2002

(65) Prior Publication Data

US 2003/0052846 A1 Mar. 20, 2003

(30) Foreign Application Priority Data

Sep. 19, 2001 (JP) ..... 2001-285687

(51) Int. Cl.[7] ..... G09G 3/36
(52) U.S. Cl. ..... 345/87; 345/92; 345/102
(58) Field of Search ..... 345/87, 89, 90, 345/92, 102, 211; 349/41, 42, 61, 117

(56) References Cited

U.S. PATENT DOCUMENTS 5,130,050 A * 7/1992 Hagiwara et al. ..... 252/299.65
5,251,050 A * 10/1993 Kurematsu et al. ..... 349/38
5,534,892 A * 7/1996 Tagawa ..... 345/173
5,731,794 A * 3/1998 Miyazawa ..... 345/88
5,912,651 A * 6/1999 Bitzakidis et al. ..... 345/58
6,108,058 A * 8/2000 Uchida ..... 349/61
6,151,004 A * 11/2000 Kaneko ..... 345/88
6,466,288 B1 * 10/2002 Rho ..... 349/141
6,597,348 B1 * 7/2003 Yamazaki et al. ..... 345/175
6,611,249 B1 * 8/2003 Evanicky et al. ..... 345/102
6,621,482 B2 * 9/2003 Fuller ..... 345/102
6,809,717 B2 * 10/2004 Asgo et al. ..... 345/102
2001/0038369 A1 * 11/2001 Adachi et al.
2004/0041766 A1 * 3/2004 Nakao et al.

* cited by examiner

*Primary Examiner*—Regina Liang
*Assistant Examiner*—Jennifer T. Nguyen
(74) *Attorney, Agent, or Firm*—Greer, Burns & Crain, Ltd.

(57) ABSTRACT

Ferroelectric liquid crystal having spontaneous polarization is provided between two confronting substrates; pixel electrodes corresponding to liquid crystal cells, TFTs for switching connected to the pixel electrodes and storage capacitors for storing electric charge in the pixel electrodes are provided on the inner face of one of the substrates;; wherein a ratio (Cs/CLC) of capacity of storage capacitor (Cs) against that of liquid crystal cell (CLC) satisfies $0.2 \leqq Cs/CLC \leqq 5$. Driving voltage for liquid crystal material is maintained at a low level, and a liquid crystal material with large spontaneous polarization can be employed.

13 Claims, 13 Drawing Sheets

LIQUID CRYSTAL DISPLAY DEVICE

BACKGROUND OF THE INVENTION

1. Field of the Invention

The present invention relates to a liquid crystal display device in which a liquid crystal material having spontaneous polarization is provided, for displaying images by on/off driving of switching elements.

2. Description of the Related Art

Along with the recent development of a so-called information-oriented society, electronic apparatus represented by personal computers, PDA (Personal Digital Assistant), etc. have come to be popularly used. As such electronic apparatus are gaining popularity more demand for portable type apparatus that can be used in an office as well as outdoors is arising, which is further creating an increasing demand for more compact and less weighing apparatus. As one of the means for meeting such a demand liquid crystal display devices are being widely used. A liquid crystal display device represents an essential technique for not only making products smaller in dimensions and lighter in weight but also for lowering power consumption of those portable type electronic apparatus driven by batteries.

Liquid crystal display devices can be classified broadly into a reflection type and a transmission type. A reflection type liquid crystal display device is so constituted that rays incidenting through the front face of liquid crystal display panel reflect from the rear face thereof, and such reflecting light makes images visible, while in a transmission type liquid crystal display device, transmitted light from a light source (back-light) provided on the rear face of liquid crystal display panel makes images visible. Since the reflection type is inferior in visibility because reflecting light amount is inconstant as it depends on circumstantial conditions, transmission type liquid crystal display devices are generally used especially for display devices of personal computers etc. for displaying multicolored or full-colored images.

Now, color liquid crystal display devices currently in popular use are generally classified into an STN (Super Twisted Nematic) type and a TFT-TN (Thin Film Transistor-Twisted Nematic) type. The STN type can be manufactured at a relatively low cost, however the disadvantage is that it is prone to crosstalk and slow in response, due to which this type is not suitable for displaying moving images. On the other hand, the TFT-TN type has a higher display quality compared to the STN type, however a back-light of a high luminance is required because light transmittance of a liquid crystal display panel is only around 4% at the current stage. Accordingly, since the TFT-TN type consumes much power for the back-light, it is not appropriate for use in an apparatus with portable batteries. Also, since colors are displayed by color filters a pixel must be constituted by three sub-pixels for red/green/blue colors, therefore it is difficult to achieve a high resolution, and besides, the purity of displayed colors is not satisfactory.

With an object to solve the foregoing problems, the inventors of the present invention have developed a liquid crystal display device of field-sequential method. The liquid crystal display device of field-sequential method does not require sub-pixels, and therefore a display with a higher resolution can be easily achieved compared to a liquid crystal display device with color filters, and moreover since colors emitted from a light source are directly used for display without using color filters, the purity of displayed colors is superior. Further, the liquid crystal display device of field sequential method achieves a higher light utilization efficiency, and therefore has another advantage of low power consumption. However, a high-speed response of liquid crystal is an essential factor for accomplishing a liquid crystal display device of field-sequential method. From such a viewpoint, the inventors of the invention are developing a technique of driving, by a switching element such as a TFT etc., liquid crystal such as a ferroelectric liquid crystal etc. that has spontaneous polarization, from which 100 to 1,000 times quicker response can be expected than conventional devices, with an object to achieve a high-speed response in liquid crystal display device of field-sequential method that has the aforementioned advantages, also in liquid crystal display device of color filter method.

In a ferroelectric liquid crystal, a direction of major axis of a liquid crystal molecule is changed by 2 θ by an application of voltage, as shown in FIG. 1. A liquid crystal display panel provided with a ferroelectric liquid crystal enclosed between a pair of substrates is placed between two polarizers that have orthogonal polarizing axis, and intensity of transmitted light is varied utilizing birefringence caused by changes of major axis direction of liquid crystal molecules. When ferroelectric liquid crystal is driven by a switching element such as a TFT, switching of spontaneous polarization is caused in proportion with an amount of charge loaded on (stored in) a pixel through the switching element, and thus the intensity of transmitted light is changed.

In a conventional liquid crystal display device wherein a liquid crystal such as a ferroelectric liquid crystal that has spontaneous polarization is driven by a switching element such as a TFT, $2Ps \cdot A$ (total charge amount of switching current resulting from a complete reversal of spontaneous polarization), where Ps is a size per unit area of spontaneous polarization and A is electrode area of each pixel, is not more than a charge amount Q loaded on each pixel through the switching element. In other words, liquid material, pixel electrodes, a TFT, etc. are designed so as to satisfy a condition of $2Ps \cdot A \leqq Q$.

In conventional devices, a maximum intensity of transmitted light is obtained by a complete reversal of spontaneous polarization under the condition of $2Ps \cdot A \leqq Q$, and therefore, when the driving voltage is as low as 7V or less, a size of spontaneous polarization Ps that satisfies the mentioned formula can only be as small as 8 $nC/cm^2$ or less due to the limited capacity of liquid crystal, and consequently responses become slow since Ps cannot be sufficiently large. Therefore it is necessary to increase the size of spontaneous polarization from a viewpoint of responsiveness, especially responsiveness at a low temperature. However, when a liquid crystal material with a large spontaneous polarization is to be employed because of responsiveness and availability of applicable liquid crystal materials, another problem arises because Q must be a large value and a high driving voltage is therefore required.

SUMMARY OF THE INVENTION

A primary object of the present invention is to provide liquid crystal display device that can be driven by a low voltage, in which nevertheless a liquid crystal material having a large spontaneous polarization can be employed.

A liquid crystal display device according to the first aspect of the invention comprises: a liquid crystal material having spontaneous polarization placed between two substrates confronting each other; pixel electrodes corresponding to liquid crystal cells and switching elements respectively connected to the pixel electrodes provided on the inner face of one of the substrates; wherein storage capacitors for storing electric charge are respectively connected to the pixel electrodes; and a ratio of capacity of the storage capacitor against that of the liquid crystal cell is not less than 0.2.

The liquid crystal display device according to the second aspect of the invention is the device of the first aspect, wherein a ratio of capacity of the storage capacitor against that of the liquid crystal cell is not more than 5.

As a result of close studies on the manner how a liquid crystal material having spontaneous polarization is driven by a switching element such as a TFT, the inventors of the invention have discovered that driving voltage can be lowered by increasing the amount of charge stored in pixels when the switching element is on and a data voltage is applied based on a display data. Accordingly, when a storage capacitor for storing the charge is provided for each pixel in addition to the capacity of the liquid crystal cell, a greater amount of charge can be stored than when the storage capacitor is not provided, consequently a driving voltage can be lowered. Further, the driving voltage can be substantially lowered when the ratio ($C_S/C_{LC}$: capacity ratio) of the capacity of the storage capacitor ($C_S$) against the capacity of the liquid crystal cell ($C_{LC}$) is not less than 0.2. The greater the capacity ratio $C_S/C_{LC}$ becomes the further the driving voltage is lowered. However, when the capacity ratio $C_S/C_{LC}$ reaches 5 the lowering effect to the driving voltage is saturated. Also, it is not preferable to increase the capacity ratio $C_S/C_{LC}$ from a viewpoint of driving capacity of the switching element such as a TFT. Consequently, it is preferable that the capacity ratio $C_S/C_{LC}$ is set within a range of 0.2 to 5.

The liquid crystal display device according to the third aspect of the invention is the device of the first and second aspects, wherein data writing time on the liquid crystal cell and the storage capacitor through the switching element is set so that amount of transmitted light due to the switching of the liquid crystal material determined by image data during off state of the switching element does not substantially change.

The liquid crystal display device according to the fourth and fifth aspects of the invention is the device of the third aspect, wherein data writing time on each pixel through the switching element is not more than 10 $\mu$s, preferably not more than 5 $\mu$s.

According to these aspects, data writing time (scanning time) on the liquid crystal cell is set so that amount of transmitted light due to the switching of the liquid crystal material determined by image data during off state of the switching element does not substantially change. Specifically, such data writing time (scanning time) is not more than 10 $\mu$s, preferably not more than 5 $\mu$s, in which case the amount of transmitted light of the liquid crystal material does not substantially change regardless of variation of the writing time if data voltage is the same, as long as the writing time is not more than the mentioned value. As a result, stabilized display of a half tone is achieved.

The liquid crystal display device according to the sixth aspect of the invention is the device of any of the first to fifth aspects, wherein the liquid crystal material is either a ferroelectric liquid crystal or an antiferroelectric liquid crystal.

In the liquid crystal display device of the sixth aspect, since the liquid crystal material is either a ferroelectric liquid crystal or an antiferroelectric liquid crystal, a high-speed response can be realized.

The liquid crystal display device according to the seventh aspect of the invention is the device of any of the first to sixth aspects, further comprising a back-light having at least one light source that emits a plurality of colors, and colors are displayed by switching the colors of emitted light of the light source in a time-divided manner, in synchronism with the switching of the liquid crystal cell by the liquid crystal material.

The liquid crystal display device of the seventh aspect is provided with a back-light having at least one light source that emits for example three primary colors of red, green and blue, and colors can be displayed by field-sequential method by switching the colors of emitted light of the light source in a time-divided manner in synchronism with the switching of the liquid crystal cell by the liquid crystal material.

The liquid crystal display device according to the eighth aspect of the invention is the device of any of the first to sixth aspects, wherein color filters are provided for displaying colors.

In the liquid crystal display device of the eighth aspect, colors are displayed by color display of a single pixel comprising three sub-pixels (liquid crystal cells) in which color filters of for example red, green and blue are provided.

The above and further objects and features of the invention will more fully be apparent from the following detailed description with accompanying drawings.

DESCRIPTION OF THE PREFERRED EMBODIMENT

Figure 1:
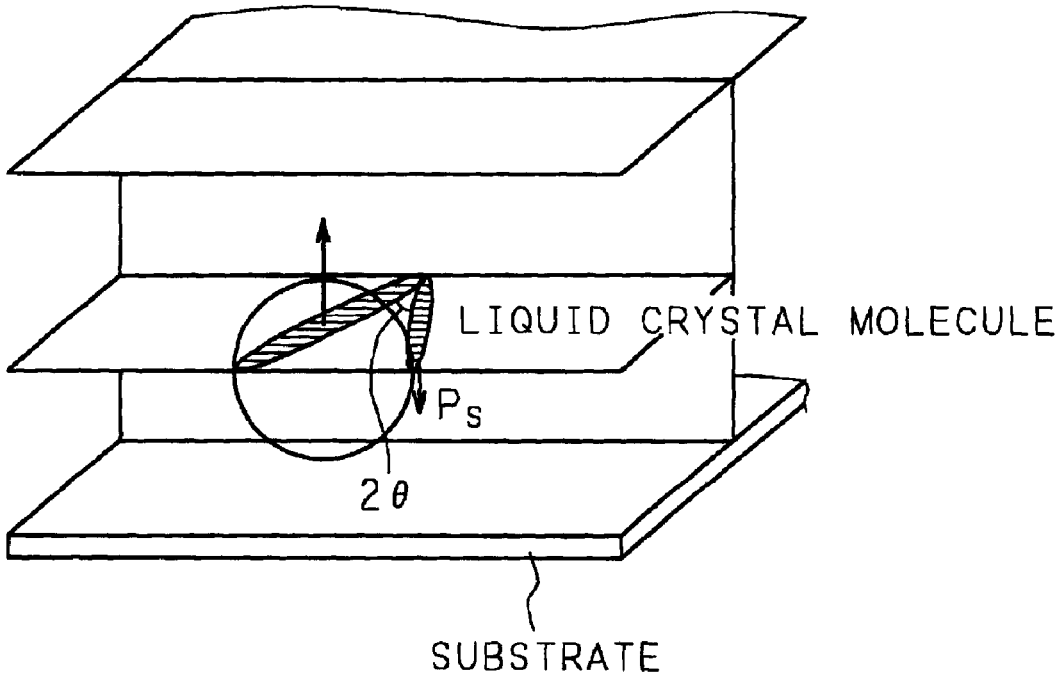
FIG. 1 PRIOR ART
FIG. 1 is a perspective view showing a configuration of liquid crystal molecules in a ferroelectric liquid crystal panel.

The present invention shall now be described in further details hereunder, referring to the drawings showing the embodiment of the invention. However it is to be understood that the invention is not limited to the following embodiment.

Figure 2:
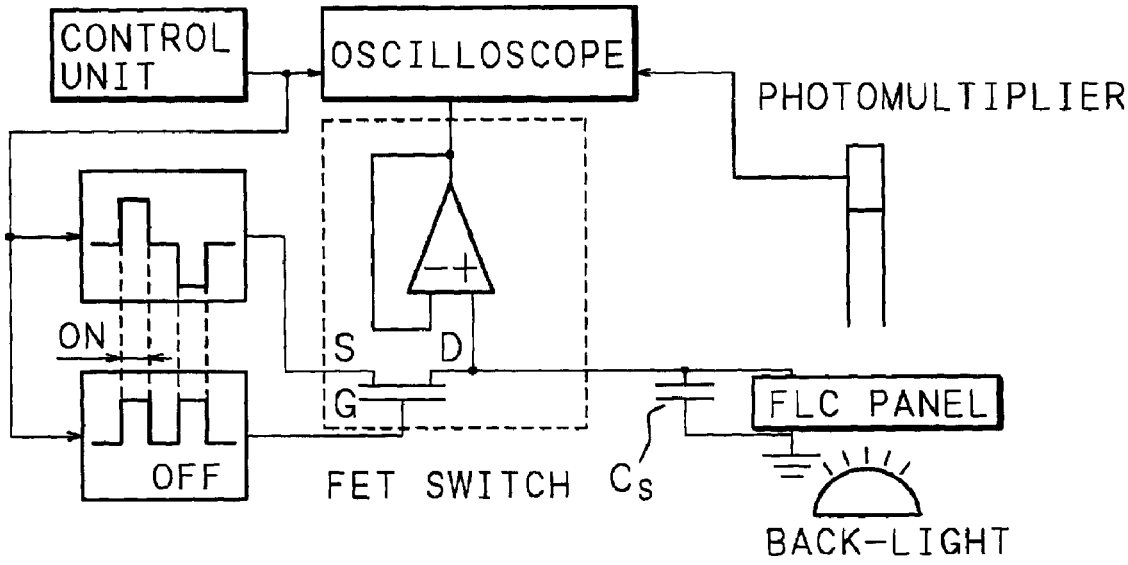
FIG. 2 is a block diagram showing a constitution of an experimental system of TFT drive evaluation characteristics of a liquid crystal cell.

First, the following is a description regarding the results of an experiment of TFT drive evaluation characteristics of liquid crystal display panel comprising a ferroelectric liquid crystal (FLC panel) in which a FET switch is used, executed by the inventors of the invention. FIG. 2 is a block diagram showing a constitution of a system of the experiment. A storage capacitor (capacity Cs) was connected in parallel to an object FLC panel (comprising a single liquid crystal cell), and a voltage was applied to the liquid crystal cell and storage capacitor through the FET switch, and then transmittance of light emitted by a back-light through the liquid crystal cell was detected by a photomultiplier.

The liquid crystal cell used as object of evaluation was made as follows. Glass substrates provided with an electrode (area: 1.77 $cm^2$) were washed first, and coated with polyimide and calcined at 200° C. for an hour to form a polyimide film of approx. 200 Å. Then the polyimide surfaces were rubbed with a rayon cloth, and two pieces of such glass substrates were confronted with a gap therebetween maintained by silica spacer of an average particle diameter of 1.6 $\mu$m to form an empty panel, in which ferroelectric liquid crystal was then sealed. Three different sizes of spontaneous polarization (Ps) of the sealed ferroelectric liquid crystal were made, i.e. 5.4 $nC/cm^2$, 8.0 $nC/cm^2$ and 12.8 $nC/cm^2$.

Using these liquid crystal panels, an intensity of transmitted light and driving voltage varying depending on a storage capacity Cs were measured while adjusting the ratio of a storage capacity Cs against a liquid crystal capacity CLC (Cs/CLC) in a range of 0 to 12 by changing the capacity of the storage capacitor (storage capacity Cs). Also, since a liquid crystal capacity CLC depends on frequency, a CLC value corresponding to a measuring frequency of 10 kHz was adopted. The reason for selecting the measuring frequency of 10 kHz was that an influence of spontaneous polarization value to the liquid crystal capacity could be eliminated.

A gate selecting period of a FET was fixed at 5 $\mu$s. Meanwhile, when the gate selecting period was set at 10 $\mu$s, the amount of transmitted light of the liquid crystal cell while the gate was off was nearly the same as when the gate selecting period was 5 $\mu$s. Accordingly, the amount of transmitted light of the liquid crystal cell while the gate is off scarcely changes regardless of the gate selecting time, as long as it is lower than 10 $\mu$s.

Figure 3:
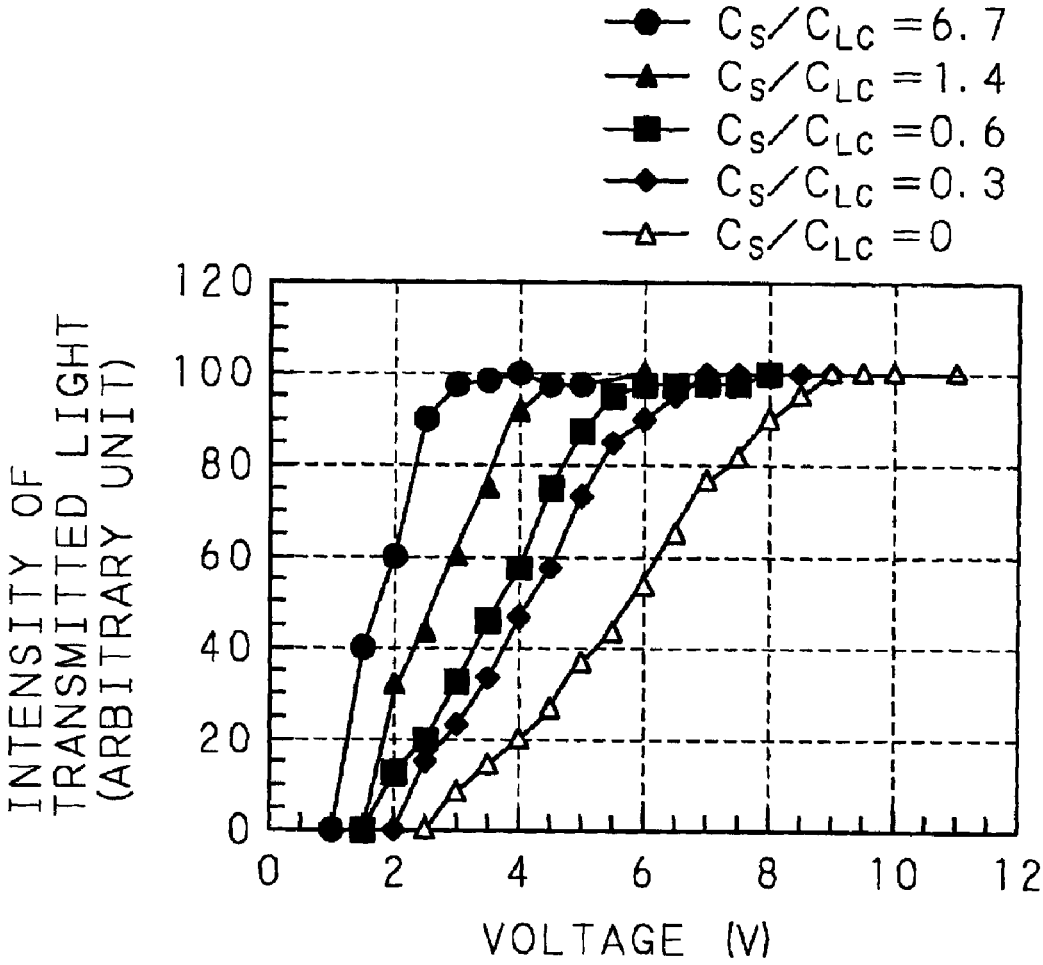
FIG. 3 is a line graph showing a relation between a voltage and an intensity of transmitted light in five steps of capacity ratio ($C_S/C_{LC}$).

FIG. 3 is a line graph showing a relation between a voltage and an intensity of transmitted light (only one polarity (+) of applied voltage) of a liquid crystal cell of the material having spontaneous polarization of Ps=12.8 $nC/cm^2$, measured in five steps of capacity ratio (Cs/CLC). In view of FIG. 3 it is understood that the lines of voltage-transmitted light characteristic are shifting to the lower voltage side as the capacity ratio Cs/CLC becomes greater.

Figure 4:
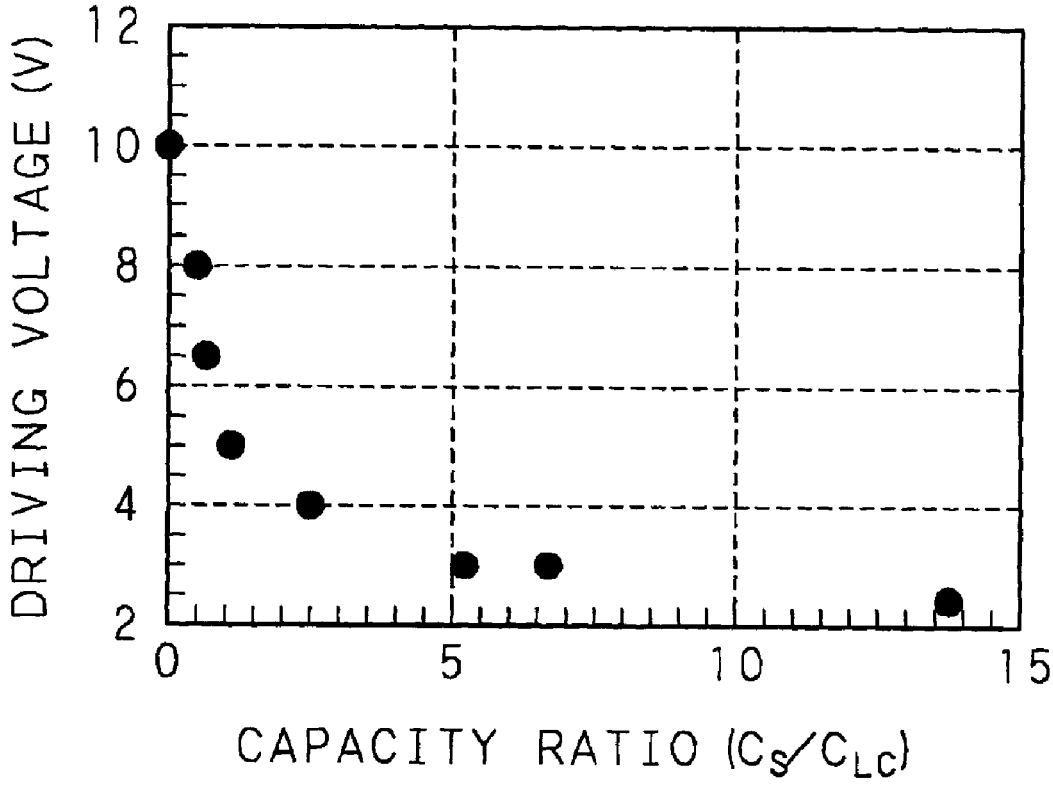
FIG. 4 is a dot graph showing a relation between a capacity ratio ($C_S/C_{LC}$) and a driving voltage.

Also, FIG. 4 is a dot graph showing a relation between a capacity ratio (Cs/CLC) and a driving voltage. From FIG. 4 it is understood that although a driving voltage is becoming lower as the value of Cs/CLC becomes greater, the effect of lowering the driving voltage is significant when the Cs/CLC is larger than 5.

Figure 5:
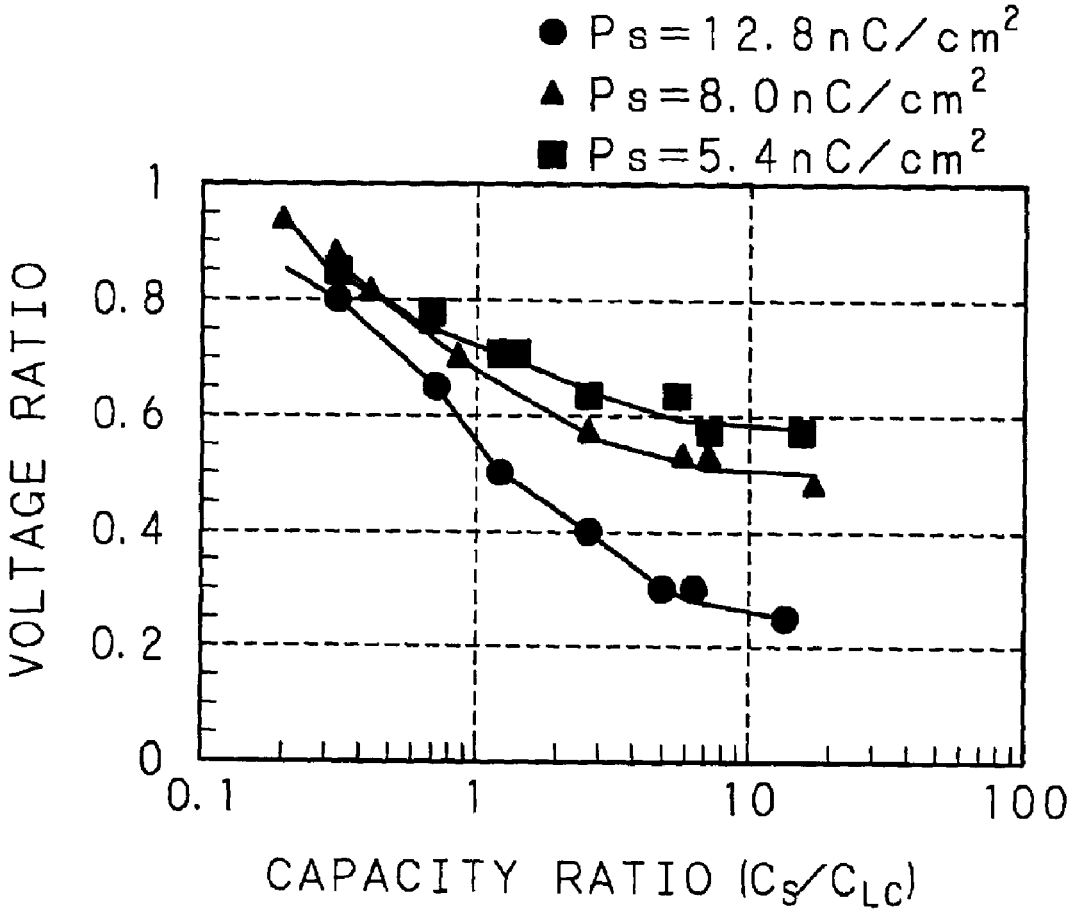
FIG. 5 is a line graph showing a relation between a capacity ratio ($C_S/C_{LC}$) and a voltage ratio in three steps of spontaneous polarization sizes.

Also, FIG. 5 is a line graph showing a relation between a capacity ratio (Cs/CLC) and a voltage ratio of liquid crystal cells of three steps of spontaneous polarization of Ps=5.4, 8.0, 12.8($nC/cm^2$). Voltage ratios indicated along the ordinate axis stand for a lowering rate of the driving voltage, in other words a ratio of a driving voltage in a case where the storage capacitor is provided against that in a case where the storage capacitor is not provided. It is understood from FIG. 5 that a lowering effect of the driving voltage is more significant when Ps is greater, than when Ps is smaller.

In view of the results of FIG. 5, it is understood that the capacity ratio should be set as $Cs/C_{LC} \geqq 0.2$ in order to lower the driving voltage by not less than 10%, though a spontaneous polarization value may have a minor influence. However, it is also understood that when the capacity ratio is set as $Cs/C_{LC} > 5$, a lowering effect of the driving voltage is not significant as shown in FIG. 4. It is not preferable to make Cs/CLC greater since it requires a large storage capacity Cs and a large driving capacity to a switching element such as a TFT. According to the foregoing, it is preferable to set the capacity ratio Cs/CLC within a range not less than 0.2 and not more than 5.

Now the specific embodiment of the invention shall be described as below.

Figure 6:
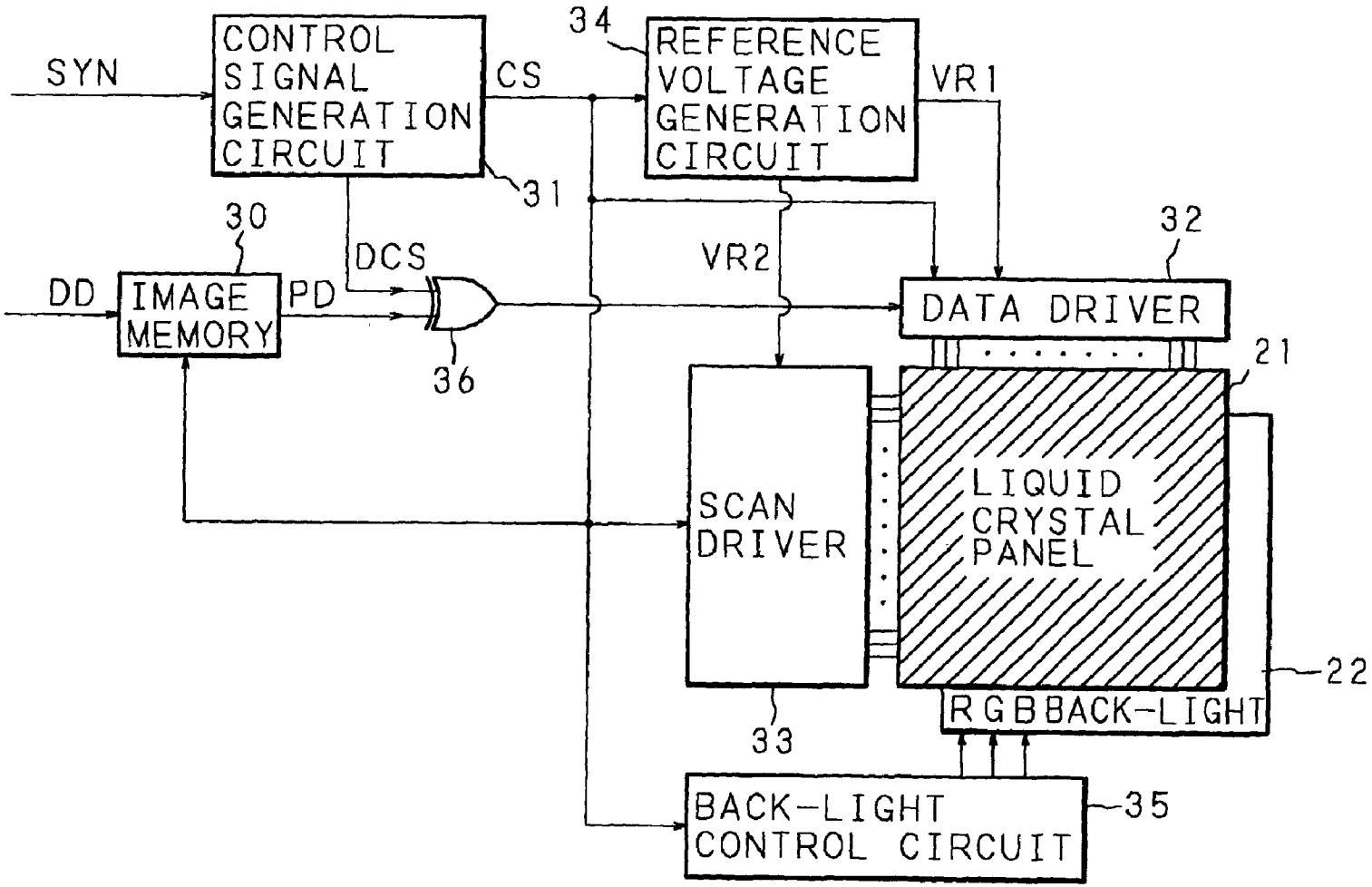
FIG. 6 is a block diagram showing a circuit configuration of liquid crystal display device.
Figure 7:
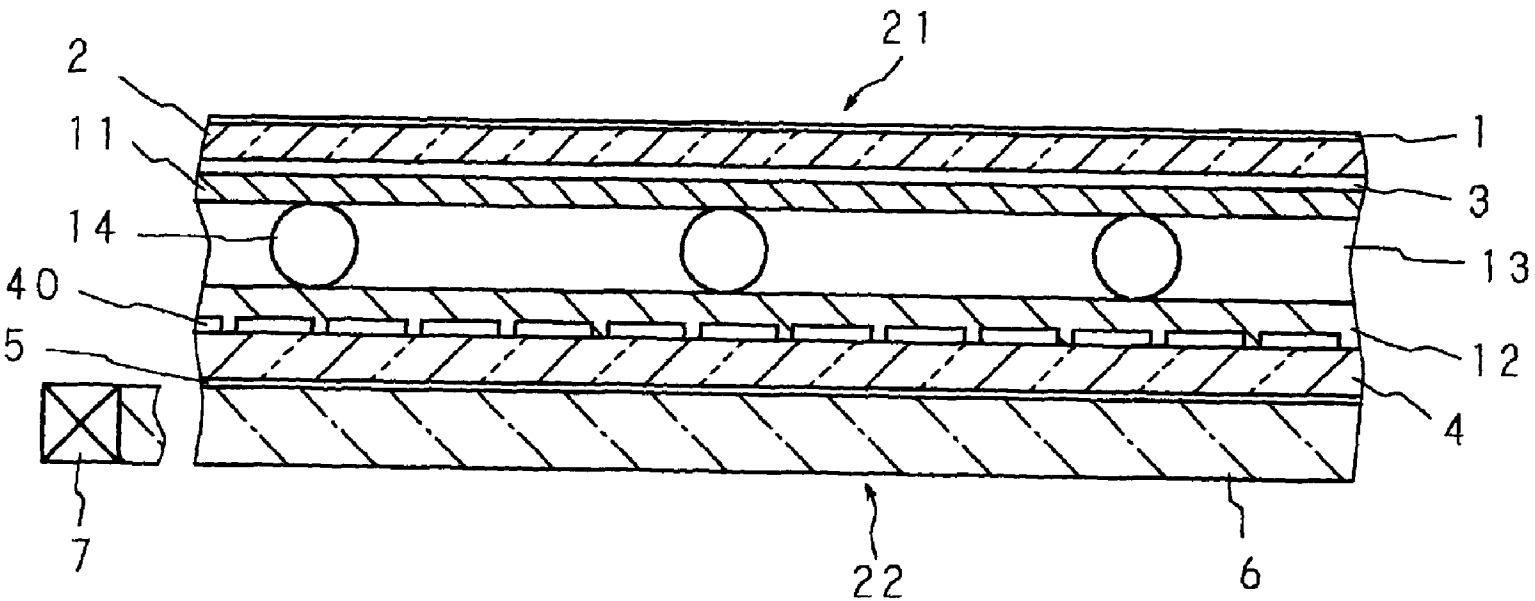
FIG. 7 is a conceptual cross-sectional view showing a structure of a liquid crystal panel and back-light.
Figure 8:
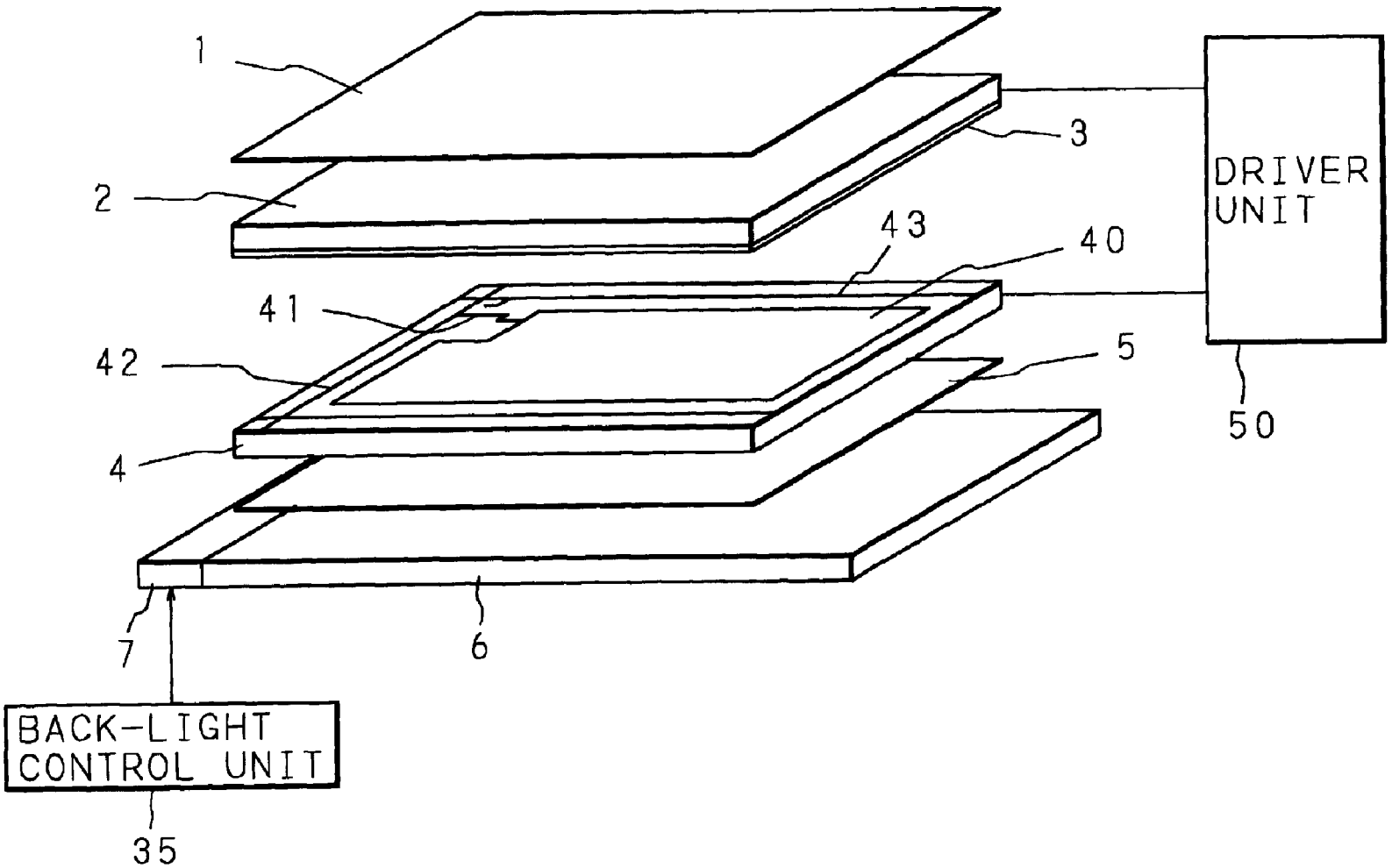
FIG. 8 is a conceptual perspective view showing a total constitution of liquid crystal display device.
Figure 9:
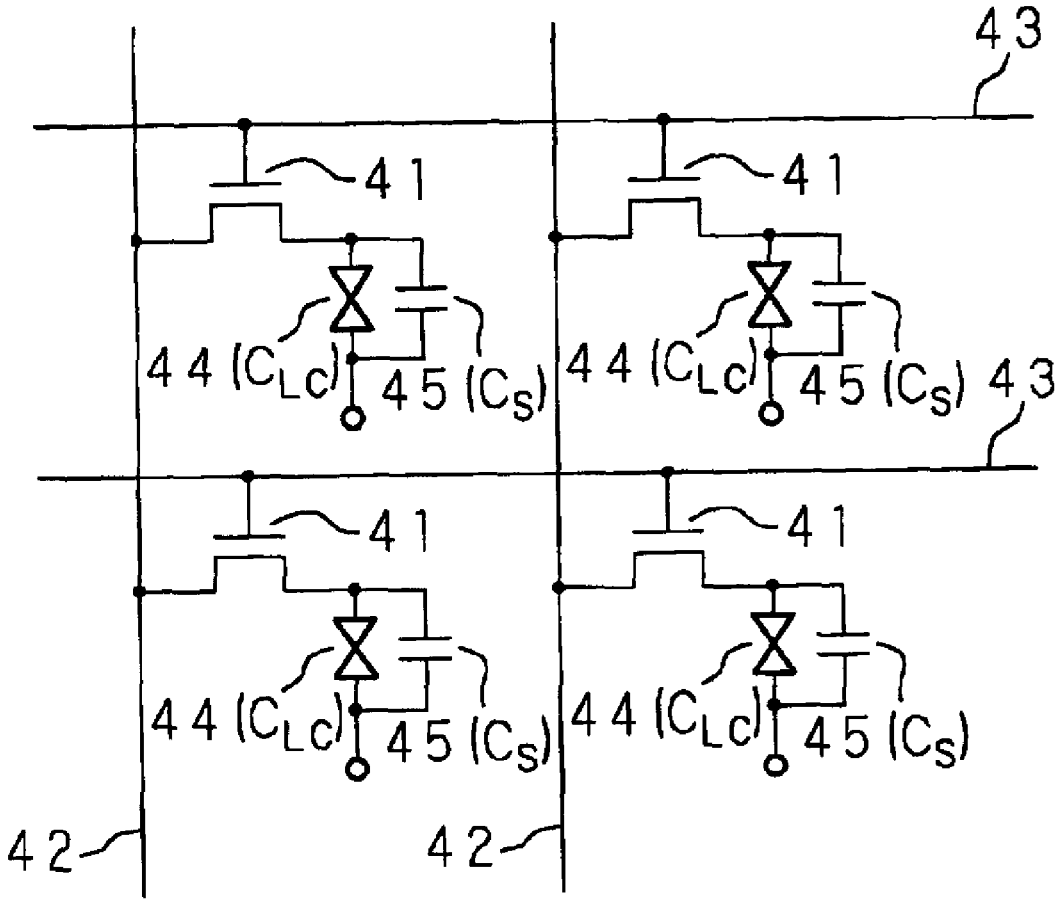
FIG. 9 is a circuit diagram of an equivalent circuit of a liquid crystal panel.
Figure 10:
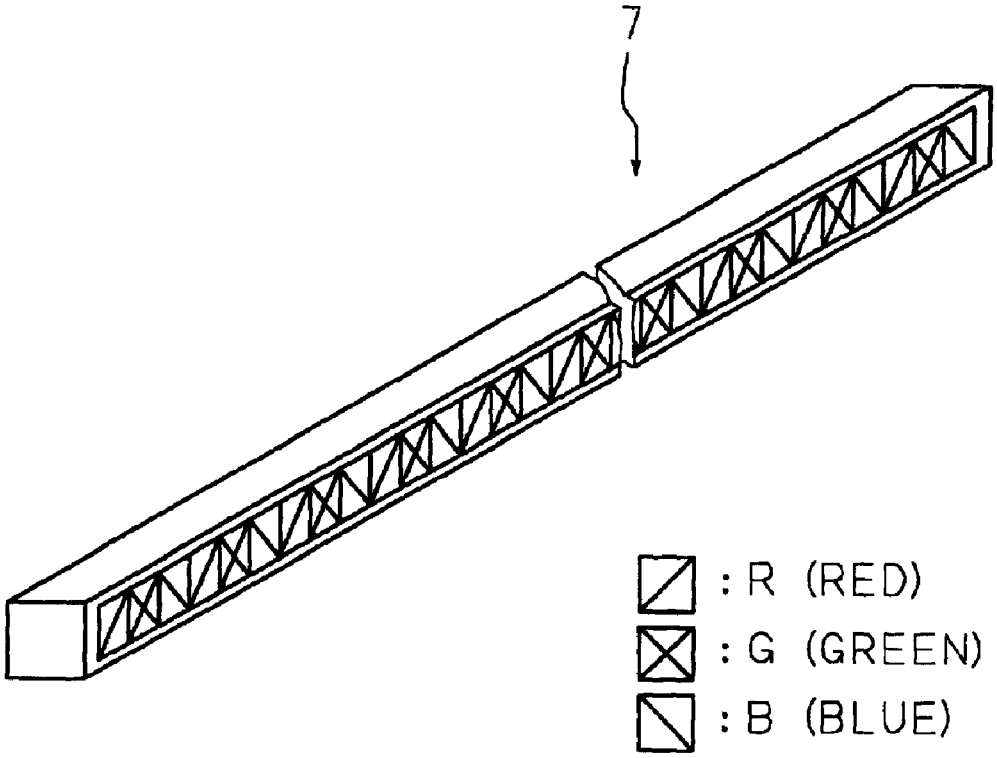
FIG. 10 is a perspective view showing a configuration of an LED array.

FIG. 6 is a block diagram showing a circuit configuration of liquid crystal display device; FIG. 7 is a conceptual cross-sectional view of a structure of a liquid crystal panel and a back-light; FIG. 8 is a conceptual perspective view showing a total constitution of liquid crystal display device; FIG. 9 is a circuit diagram of an equivalent circuit of a liquid crystal panel; and FIG. 10 shows a configuration of an LED array that serves as light sources of the back-light.

Referring to FIGS. 7 and 8, a liquid crystal panel 21 is constituted of a polarizing film 1, a glass substrate 2, a common electrode 3, glass substrate 4 and polarizing film 5 laminated in the mentioned order from the upper layer (front face) side toward the lower layer (rear face) side, and a plurality of pixel electrodes 40, 40 . . . disposed in a matrix configuration are provided on a face of the glass material 4 facing the common electrode 3.

A plurality of liquid crystal cells 44 disposed in a matrix configuration are formed between the common electrode 3 and each of the pixel electrodes 40, 40 . . . , and a driver unit 50 comprising a data driver 32, a scan driver 33 etc. is connected to each of the liquid crystal cells 44 through a TFT 41 to be described later. The data driver 32 is connected to the TFT 41 through a signal line 42, and the scan driver 33 is connected to the TFT 41 through a scanning line 43. On/off of the TFT 41 is controlled by the scan driver 33. Also each of the pixel electrodes 40, 40 . . . is controlled by the TFT 41. Therefore an intensity of transmitted light of the individual liquid crystal cells 44 is controlled by signals from the data driver 32 provided through the signal line 42 and the TFT 41. Also, as shown in FIG. 9, a storage capacitor 45 (storage capacity Cs) connected to the TFT 41 in parallel with the liquid crystal cell 44 (capacity CLC) is provided so that the charge amount that can be stored in each pixel can be increased. By such an arrangement a value of Cs/CLC satisfies $0.2 \leqq Cs/C_{LC} \leqq 5$. Accordingly a combination of the liquid crystal cell 44, the TFT 41 and the storage capacitor 45 shall be referred to as a "pixel" in this embodiment.

An alignment layer 12 is provided on the upper face of the pixel electrodes 40, 40 . . . on the glass substrate 4, and an alignment layer 11 on the lower face of the common electrode 3 respectively, and a liquid crystal material is filled between the alignment layers 11 and 12 so that a liquid crystal layer 13 is formed. By the way, numeral 14 stands for spacers to maintain the layer thickness of the liquid crystal layer 13.

The liquid crystal panel 21 in FIGS. 7 and 8 was practically made up as follows. The TFT substrate 4 provided with the pixel electrodes 40, 40 . . . (number of pixels: 640×480, area of electrode: $6\times10^{-5}$ cm$^2$, storage capacity Cs: 0.2 pF, diagonal: 3.2 inches) and the glass substrate 2 provided with the common electrode 3 were washed first, and coated with polyimide and calcined at 200° C. for an hour to form a polyimide film of approx. 200 Å, which serves as the alignment layers 11, 12.

Such alignment layers 11, 12 were rubbed with a rayon cloth, and both of them were confronted with a gap therebetween maintained by the silica spacer 14 of an average particle diameter of 1.6 $\mu$m to form an empty panel. Then ferroelectric liquid crystal mainly composed of a liquid crystal of naphthalene family having spontaneous polarization of 12.8 nC/cm$^2$ was sealed between the alignment layers 11, 12 in the empty panel, so that the liquid crystal layer 13 was formed. A liquid crystal capacity $C_{LC}$ at this stage was 0.23 pF. A capacity ratio $C_S/C_{LC}$ was therefore 0.87. Finally the two polarizing films 1, 5 in a crossed-Nicol state were respectively laid over the surfaces of both sides of the panel constituted as above, in such a manner that liquid crystal became dark when ferroelectric liquid crystal molecules of the liquid crystal layer 13 were inclined in one direction, and the panel thus constituted was used as the liquid crystal panel 21.

Figure 11:
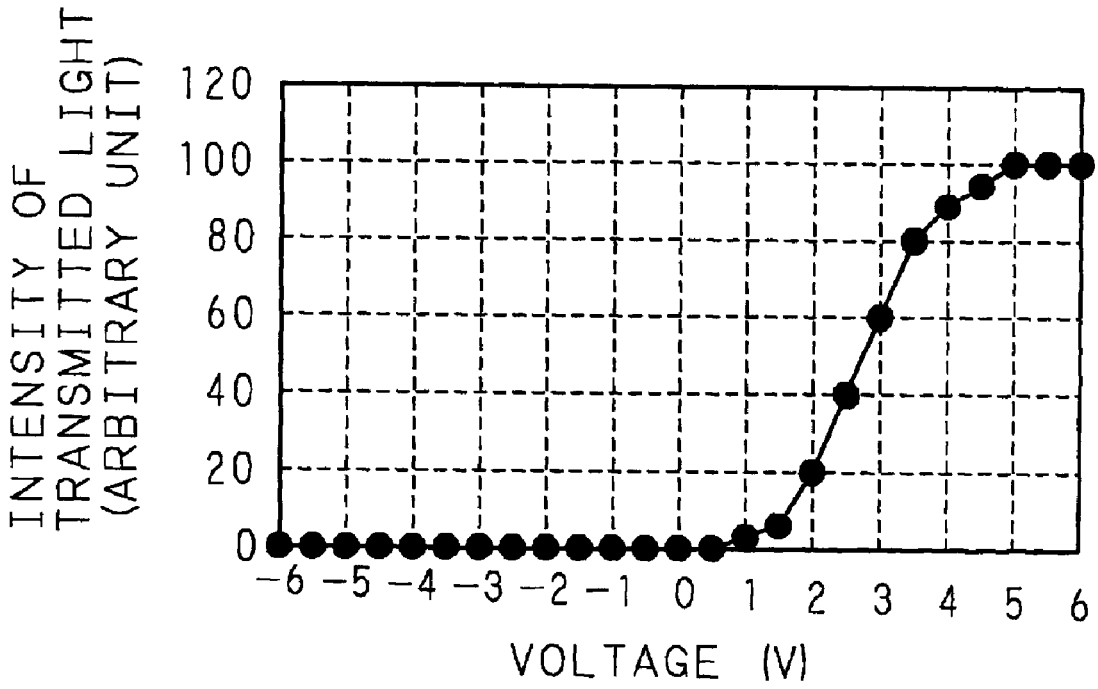
FIG. 11 is a line graph showing a relation between a voltage and an intensity of transmitted light according to the embodiment of the present invention.

Various voltages were applied to each of the liquid crystal cells 44 and the storage capacitor 45 of the liquid crystal panel 21 constituted as above through switching of the TFT 41, and an intensity of transmitted light was measured, the results of which are shown in FIG. 11. These results have proved that the liquid crystal panel 21 can be driven by a voltage as low as 5V.

A back-light 22 is placed on the lower layer (rear face) side of liquid crystal panel 21, and is provided with an LED array 7 adjoining along an end face of a light leader/diffuser 6 that forms a light emitting zone. The LED array 7 comprises LEDs that emit three primary colors, i.e. red, green and blue (hereinafter referred to as "RGB"), aligned in repeated sequences along its end face confronting the light leader/diffuser 6. The LEDs in the LED array 7 emit RGB colors respectively in each of RGB sub frames of the field-sequential method to be described later. The light leader/diffuser 6 leads the light emitted from each LED to all over its surface and diffuses the light toward the upper face, so as to serve as a light emitting zone.

Referring to FIG. 6, numeral 30 stands for an image memory for memorizing inputted display data DD when display data is inputted from an exterior source such as a personal computer, and 31 stands for a control signal generation circuit for generating a control signal CS and a data inversion control signal DCS when a synchronizing signal SYN is inputted from the personal computer. The image memory 30 outputs pixel data PD, and a control signal generation circuit 31 outputs a data reversal control signal DS respectively, to a data inversion circuit 36. The data inversion circuit 36 generates reverse pixel data #PD that is inverted data of inputted pixel data PD, according to the data inversion control signal DCS.

Likewise, control signal generation circuit outputs a control signal CS to the reference voltage generation circuit 34, the data driver 32, the scan driver 33 and the back-light control circuit 35 respectively. The reference voltage generation circuit 34 generates references voltage VR1 and VR2, and outputs VR1 to the data driver 32, and VR2 to the scan driver 33 respectively. The data driver 32 outputs a signal to the signal line 42 of the pixel electrode 40, based on the pixel data PD or the reverse pixel data #PD received from image memory 30 through the data inversion circuit 36. In synchronism with the output of the mentioned signal, the scan driver 33 sequentially scans each of scanning lines 43 on the pixel electrode 40. And the back-light control circuit 35 supplies a driving voltage to the back-light 22, so that the respective LED of RGB colors in the LED array 7 provided in the back-light 22 emits a light in a time-divided manner.

Hereunder, operations of liquid crystal display device according to the invention shall be described. Display data DD of each of RGB colors to be displayed by the liquid crystal panel 21 is provided to the image memory 30 by a personal computer. The image memory 30 temporarily memorizes the display data DD, and outputs pixel data PD that is the data for each pixel upon receiving a control signal CS outputted from the control signal generation circuit 31. When the display data DD is provided to the image memory 30, a synchronizing signal SYN is provided to the control signal generation circuit 31, which generates and outputs a control signal CS and a data inversion control signal DCS when the synchronizing signal SYN is inputted. The pixel data PD outputted from the image memory 30 is provided to the data inversion circuit 36.

The data inversion circuit 36 lets the pixel data PD pass as it is when the data inversion control signal DCS outputted from the control signal generation circuit 31 is at L level, while generates and outputs reverse pixel data #PD when the data inversion control signal DCS is at H level. Therefore the control signal generation circuit 31 sets the data inversion control signal DCS at L level when scanning for data writing, and at H level when scanning for data erasing.

The control signal CS generated by the control signal generation circuit 31 is provided to the data driver 32, the scan driver 33, the reference voltage generation circuit 34 and the back-light control circuit 35. The reference voltage generation circuit 34 generates reference voltages VR1 and VR2 upon receiving the control signal CS, and outputs the generated VR1 to the data driver 32, and VR2 to the scan driver 33 respectively.

The data driver 32 outputs a signal to the signal line 42 of the pixel electrode 40, based on the pixel data PD or the reverse pixel data #PD outputted from the image memory 30 through the data inversion circuit 36. Scan driver 33 sequentially scans each of scanning lines 43 on the pixel electrode 40, upon receiving the control signal CS. The TFT 41 is then activated according to the output of the signal from data driver 32 and the scanning by the scan driver 33, so that a voltage is applied to the pixel electrode 40 for controlling an intensity of transmitted light of pixels.

The back-light control circuit 35 supplies a driving voltage to the back-light 22 upon receiving the control signal CS, so that the respective LEDs of RGB colors in the LED array 7 provided in the back-light 22 emit light in a time-divided.

Figure 12:
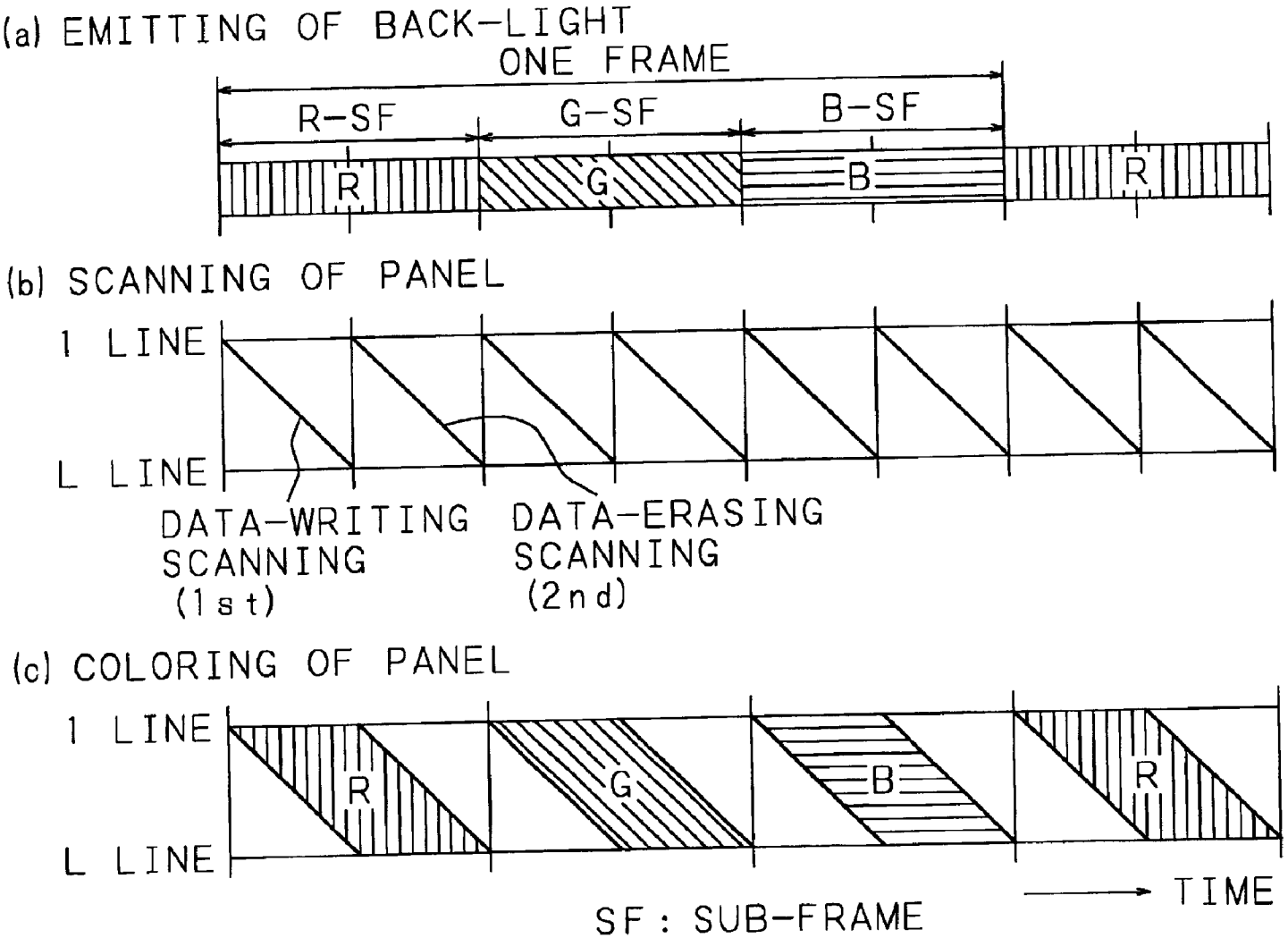
FIG. 12 is a time chart showing arrangements of display control in liquid crystal display device.

In the liquid crystal display device according to the foregoing description, display control is operated according to a time chart of field sequential method shown in FIG. 12. FIG. 12(*a*) shows a light emitting timing of each LED of the respective colors of the back-light 22, FIG. 12(*b*) a scanning timing of each scanning line of the liquid crystal panel 21, and FIG. 12(*c*) a coloring pattern of the liquid crystal panel 21, respectively.

One frame is split into three sub-frames, and as shown in FIG. 12(*a*) each LED for each of RGB colors sequentially emits light in the respective sub-frames from the first to the third. And colors are displayed by switching each line of each pixel of the liquid crystal panel 21 in synchronism with the sequential light emitting of the respective colors.

Meanwhile, as shown in FIG. 12(*b*) data scanning of the liquid crystal panel 21 is performed twice in the sub-frame of the respective RGB colors. Here, it is preferable to arrange the scanning timing in such a manner that starting timing (timing for the first line) of the first scanning (data-writing scanning) accords with starting timing of each sub-frame, and finishing timing (timing for the last line) of the second scanning (data-erasing scanning) accords with finishing timing of each sub-frame. In addition, according to the invention, a gate selecting period of the TFT 41 corresponding to a scanning time for one line is set at not greater than 10 $\mu$s, more preferably at not greater than 5 $\mu$s, so that the amount of transmitted light of the liquid crystal cell while the gate of the TFT 41 is off does not substantially change regardless of a value of the gate selecting period.

For data-writing scanning, a voltage according to pixel data PD is supplied to each pixel of the liquid crystal panel 21, so that light transmittance is thus adjusted. As a result, a full color display is executed. Also, for data-erasing scanning, a voltage that is practically the same as but of a reverse polarity to that of data-writing scanning is supplied to each pixel of the liquid crystal panel 21, therefore display of each pixel of the liquid crystal panel 21 is erased, and an application of a direct current component to the liquid crystal cell is prevented.

As a result of operating the liquid crystal display device of the invention by the field sequential method in the foregoing manner, a color display of high quality with a sufficient brightness and excellent color purity was accomplished.

A COMPARATIVE EXAMPLE

A ferroelectric liquid crystal material having spontaneous polarization of 12.8 nC/cm$^2$ was sealed in an empty panel made in the same way as that of the foregoing embodiment except that a storage capacitor for storing electric charge was not provided, and two polarizing films in a crossed-Nicol state were respectively laid over the surfaces of both sides of the panel in such a manner that liquid crystal became dark when ferroelectric liquid crystal molecules were inclined in one direction, and the liquid crystal panel thus constituted was used for this comparative example. A capacity $C_{LC}$ of liquid crystal cells of the liquid crystal panel for comparison was 0.23 pF similarly to that of the foregoing embodiment. A capacity ratio $C_S/C_{LC}$ was naturally 0 since a storage capacitor was not provided.

Figure 13:
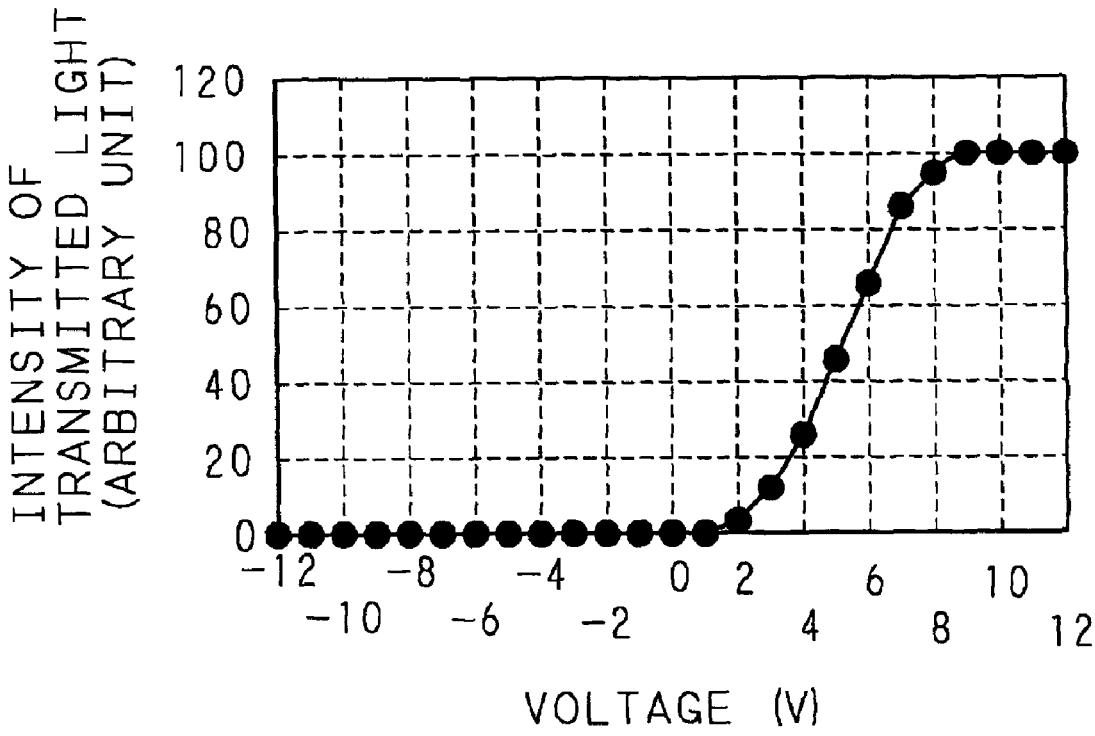
FIG. 13 is a line graph showing a relation between a voltage and an intensity of transmitted light according to the comparative example.

Various voltages were applied through switching of the TFT 41 to each of liquid crystal cells of the liquid crystal panel constituted as above for the comparison, and an intensity of transmitted light was measured, the results of which are shown in FIG. 13. These results show that a voltage as high as 9V is required for driving the liquid crystal panel for comparison.

Now, in the foregoing embodiment, a ferroelectric liquid crystal material was used as a liquid crystal material that has spontaneous polarization, whereas a similar advantage will naturally be presented when an antiferroelectric liquid crystal material, especially one that has a V-shaped voltage—light transmittance characteristics (the same amount of transmitted light is attained by both positive and negative voltages) is employed.

Further, in the foregoing embodiment color display was performed by the field sequential method wherein an individual light source for each of RGB colors was used, whereas it is also possible to utilize a single light source that can emit any of RGB colors by switching, and moreover, it is a matter of course that the invention is also applicable to a device in which color display is performed by color filters of RGB colors.

As described so far, in the liquid crystal display device according to the invention, a storage capacitor for storing electric charge is connected to a pixel electrode of the liquid crystal cell, and a ratio of a capacity of the storage capacitor against that of the liquid crystal cell is set at not less than 0.2 and not greater than 5, and as a result a liquid crystal material having spontaneous polarization can be driven by a low voltage.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A liquid crystal display device, comprising:

two substrates confronting each other;

a liquid crystal material having spontaneous polarization sealed between said substrates;

pixel electrodes corresponding to liquid crystal cells, provided on an inner face of one of said substrates;

switching elements respectively connected to each of said pixel electrodes; and storage capacitors for storing electric charge, respectively connected to each of said pixel electrodes;

wherein a capacity of said storage capacitor is greater than or equal to 0.2 times a capacity of said liquid crystal cell, and less than 5 times said capacity of said liquid crystal cell, and wherein a data writing time on said liquid crystal cell and said storage capacitor through said switching element is set so that an amount of transmitted light due to the switching of said liquid crystal material determined by image data during an off state of said switching element does not substantially change.

2. The liquid crystal display device as set forth in claim 1, wherein data writing time on said liquid crystal cell through said switching element is not more than 10 microsecond.

3. The liquid crystal display device as set forth in claim 2, wherein the data writing time on said liquid crystal cell through said switching element is not more than 5 $\mu$s.

4. The liquid crystal display device as set forth in claim 3, wherein said liquid crystal material is either a ferroelectric liquid crystal or an antiferroelectric liquid crystal.

5. The liquid crystal display device as set forth in claim 3, further comprising:

a back-light having at least one light source that emits light of a plurality of colors; and a switching unit for switching colors of emitted light of said light source in a time-divided manner in synchronism with the switching of said liquid crystal material of said liquid crystal cell.

6. The liquid crystal display device as set forth in claim 2, wherein said liquid crystal material is either a ferroelectric liquid crystal or an antiferroelectric liquid crystal.

7. The liquid crystal display device as set forth in claim 2, further comprising:

a back-light having at least one light source that emits light of a plurality of colors; and a switching unit for switching colors of emitted light of said light source in a time-divided manner in synchronism with the switching of said liquid crystal material of said liquid crystal cell.

8. The liquid crystal display device as set forth in claim 1, wherein said liquid crystal material is either a ferroelectric liquid crystal or an antiferroelectric liquid crystal.

9. The liquid crystal display device as set forth in claim 8, further comprising:

a back-light having at least one light source that emits light of a plurality of colors; and a switching unit for switching colors of emitted light of said light source in a time-divided manner in synchronism with the switching of said liquid crystal material of said liquid crystal cell.

10. The liquid crystal display device as set forth in claim 1, wherein said liquid crystal material is either a ferroelectric liquid crystal or an antiferroelectric liquid crystal.

11. The liquid crystal display device as set forth in claim 1, further comprising a back-light having at least one light source that emits light of a plurality of colors; and a switching unit for switching colors of emitted light of said light source in a time-divided manner in synchronism with the switching of said liquid crystal material of said liquid crystal cell.

12. The liquid crystal display device as set forth in claim 1, further comprising:

a back-light having at least one light source that emits light of a plurality of colors; and a switching unit for switching colors of emitted light of said light source in a time-divided manner in synchronism with the switching of said liquid crystal material of said liquid crystal cell.

13. The liquid crystal display device as set forth in claim 1, further comprising color filters for displaying colors.

* * * * *